US009125505B2

(12) United States Patent
Morris et al.

(10) Patent No.: US 9,125,505 B2
(45) Date of Patent: Sep. 8, 2015

(54) CUP SLEEVE HOLDER APPARATUS

(71) Applicants: Jeffrey M Morris, Lincolnshire, IL (US); David C Wheeler, Barrington, IL (US)

(72) Inventors: Jeffrey M Morris, Lincolnshire, IL (US); David C Wheeler, Barrington, IL (US)

( * ) Notice: Subject to any disclaimer, the term of this patent is extended or adjusted under 35 U.S.C. 154(b) by 0 days.

(21) Appl. No.: 14/176,317

(22) Filed: Feb. 10, 2014

(65) Prior Publication Data

US 2014/0224817 A1 Aug. 14, 2014

Related U.S. Application Data

(60) Provisional application No. 61/850,226, filed on Feb. 11, 2013.

(51) Int. Cl.

| | |
|---|---|
| ***B65D 25/36*** | (2006.01) |
| ***B65D 25/34*** | (2006.01) |
| ***A47G 23/02*** | (2006.01) |
| *B65D 25/20* | (2006.01) |

(52) U.S. Cl.
CPC ..... *A47G 23/0216* (2013.01)

(58) Field of Classification Search
CPC ..... A47G 23/0216; A47G 23/0266; A47G 23/0208; B65D 81/3876; B65D 23/065
USPC ..... 220/737, 738, 739; 215/392, 62
See application file for complete search history.

(56) References Cited

U.S. PATENT DOCUMENTS

| | | | | |
|---|---|---|---|---|
| 2,979,301 | A * | 4/1961 | Reveal | 248/214 |
| 5,205,473 | A | 4/1993 | Coffin | |
| 5,425,497 | A | 6/1995 | Sorensen | |
| 5,826,786 | A | 10/1998 | Dickert | |
| 6,315,192 | B1 * | 11/2001 | Marlow | 229/401 |
| 6,749,082 | B1 * | 6/2004 | Nickel | 220/738 |
| 2006/0102637 | A1 * | 5/2006 | Robertson et al. | 220/737 |

(Continued)

*Primary Examiner* — Mickey Yu
*Assistant Examiner* — Niki Eloshway
(74) *Attorney, Agent, or Firm* — Jeffrey M. Morris

(57) ABSTRACT

A holding sleeve for use with a cup, the cup having a top end and an outer wall and comprising a substantially flat longitudinal and continuous elongated strip. The strip has a first end and a second end. The first end is spaced apart and distant from said second end. Attachment means is on at least either the first end or the second end for connecting the first end to the second end to form a hollow band. The band has a top edge, an inside surface and an outside surface. The band has mounting means on the band for positioning the band onto the cup where the top edge of the band is proximal to the top end of the cup and the inside surface of the band is contiguous to the sidewall of the cup to provide a snug fit between the band and the sidewall. At least one moveable tab on the top edge of the band. The tab has a top part and a bottom part. The top edge of the band has the shape of a first arc and the bottom part of the tab has the shape of a second arc. The first arc and the second arc coincide to form a hinge. The hinge has an apex. The hinge has means for the movement of the tab between a first position, where the tab extends towards the top end of the cup and is in close proximity to the sidewall of the cup and a second position where the tab extends away from the sidewall of the cup and the outer surface of the band. The hinge also has engagement means for exerting sufficient pressure against the sidewall of the cup when concomitant pressure is applied against the tab when the tab is in the second position to substantially restrict the movement of the tab to the first position. The tab has support means for holding the cup when the tab is in the second position where the shape of the top part, when the tab is in the second position, conforms to the curvature of the hinge.

9 Claims, 16 Drawing Sheets

(56) References Cited

U.S. PATENT DOCUMENTS

| | | | | |
|---|---|---|---|---|
| 2007/0205204 | A1* | 9/2007 | Novak | 220/737 |
| 2009/0050767 | A1* | 2/2009 | Stone et al. | 248/311.2 |
| 2009/0230082 | A1* | 9/2009 | Dickerson | 215/395 |
| 2010/0200603 | A1 | 8/2010 | Kim et al. | |
| 2010/0224641 | A1* | 9/2010 | Hanel | 220/737 |
| 2011/0233223 | A1* | 9/2011 | Cook et al. | 220/738 |
| 2012/0255928 | A1 | 10/2012 | Greenberg | |
| 2013/0264349 | A1* | 10/2013 | Papanikolaou | 220/739 |
| 2013/0270283 | A1* | 10/2013 | Yang et al. | 220/739 |

* cited by examiner

CUP SLEEVE HOLDER APPARATUS

This application claims the benefit of U.S. Provisional Application No. 61/850,226 filed Feb. 11, 2013.

BACKGROUND OF THE INVENTION

The present invention relates to a cup sleeve holder for use with a hot or cold beverage drinking cup. In particular, the invention relates to a tubular band or sleeve preferably made out of recyclable material, such as corrugated paper, which fits snugly around the circumference of a drinking cup. The band comprises at least two tabs located on opposite sides of the top edge of the band which extend transversely against the cup sidewall and act as a support or shelf to rest on the top of a drinker's hand. The tabs move about a hinge whereby the end closest to the cup sidewall comes to rest against the cup sidewall. When the sleeve is mounted on the cup and is being held in one hand, the weight of the cup and its contents produces an upward force against each of the tabs which in turn causes the tab to move about the hinge in a downward direction thereby causing the closest tab end to the cup sidewall to tightly engage with the cup sidewall. This engagement precludes the tab from moving further in an upward directly thereby causing the tab to stabilize in a substantially horizontal juxtaposition with the cup as the cup rests on the top of the user's first curved finger and thumb. The tabs provide a simple, comfortable, stable and strong support for holding the cup while drinking a hot or cold beverage.

Drinking cups are a ubiquitous product in the beverage industry. Billions of cups are sold annually throughout the world. It is common to use drinking cups made out of Styrofoam, paper products and the like, especially for restaurants, convenience stores and fast food shops. While Styrofoam cups continue to be very popular, the cup industry increasingly produces and sells paper cups due to environmental concerns since Styrofoam does not biodegrade as quickly as paper. One of the disadvantages of using a paper cup is that its thermal insulating property is far less efficient than a Styrofoam cup. One's fingers can be easily burned when holding a fresh paper coffee cup without additional thermal protection. This significant disadvantage spawned the development of what is known in the art as a "sleeve" which is customarily made out of a corrugated paper product in the shape of a tubular sleeve or band which fits snugly around the cup. The sleeve comprises insulating properties such as annular grooves, vertical flutes or multiple nubbins and depressions interspersed about the inside and/or outside wall of the sleeve which gives some protection from the heat transference of the contents of the cup by increasing the space between the cup sidewall and the hand. Notwithstanding this improvement, the insulating properties of the corrugated sleeves shown in the prior art fail to adequately protect the user from being burned or at least feeling the heat through the cup from the hot liquid especially from a fresh cup of coffee which often times can cause the user to spill or drop the cup due to the sever heat. Further, the sleeves of the prior art provide no additional advantage or convenience in holding, stabilizing or gripping the cup while carrying it or drinking its contents.

The prior art has attempted to address the disadvantages of the corrugated paper sleeves. For example, U.S. Pat. No. 5,425,497 and U.S. Pat. No. 5,826,786 show a band of paper material with a plurality of nubbins and depressions dispersed along the inner and outer side of the band. U.S. Pat. No. 5,205,473 discloses a paper band with a fluted structure disposed along the outside of the band which helps protect the user's hand and fingers from the heat transfer of the hot liquid.

U.S. Pat. No. 5,669,553 discloses a cup sleeve with a plurality of concentric ring-like bands which are aligned and connected to one above the other so as to form a unitary sleeve by peripheral ridges extending from the bottom edge of one band to the top edge of the next adjacent band. While these bands may offer some insulation from the heat transference of the cup contents, they still do not offer an effective insulated product to protect the user from a very hot beverage.

Another disadvantage of using a paper cup containing a hot liquid is that the user has a tendency to grip the sides of the cup with less pressure than is normally needed and desired to maintain control, because the cup is too hot to hold tightly. As a way of avoiding being burned by the hot cup surface, a user may tend to hold the cup with the last one or two fingers of their cup-holding-hand in order to support the bottom of the cup so that the user's grip of the cup need not be as tightly held tightly. Even with the use of a cup sleeve as shown in the prior art, this problem is not alleviated since the insulating qualities of the sleeves are not sufficiently adequate to protect the user from all of the heat transference of the contents of the cup. Either the sleeve is not thick enough to minimize heat transfer or the space between the sleeve and the cup sidewall is not wide enough to provide insulation, or the material does not have sufficient insulating qualities or design to protect the user.

The prior art has attempted to correct the aforementioned disadvantages by providing a cup sleeve with finger holders to provide additional protection and stability. U.S. Patent 2010/0200603 shows a sleeve which has protrusions extending horizontally from the band which are used to support only one a finger. These protrusions are very small and can tear or bend easily especially when holding a full cup of coffee thereby causing the cup to lose stability and fall out of the user's hand.

Consequently, there is a need for a cup sleeve which not only permits one to drink comfortably while holding a full cup of hot coffee, but also aids in the prevention of spillage of the cup's contents by providing a sturdy support to hold and grip the cup while also protecting the user's fingers from the intense heat of the cup's contents, especially when the coffee is first served.

BRIEF SUMMARY OF THE INVENTION

In accordance with the present invention, these and other problems are overcome by providing a holding sleeve to be used with a cup having a top end and an outer sidewall. The sleeve comprises a substantially flat longitudinal and continuous strip. The strip comprises a first end and a second end spaced apart and distant from the second end. Attachment means is on at least either the first end or the second end for connecting the first end to the second end to form a hollow band. Mounting means are on the band for positioning the band onto the cup where the top edge of the band is proximal to the top end of the cup and the inside surface of the band is contiguous to the sidewall of the cup to provide a snug fit between the band and the sidewall. At least one tab is on the top edge of the band. The band comprises a top part and a bottom part. The top edge of the band comprises the shape of a first arc. The bottom part of the tab comprises the shape of a second arc. The first arc and the second arc coincide with each other to form hinge. The hinge comprises means for facilitating the pivotal movement of the tab between a first position where the tab extends towards the top end of the cup and is in close proximity to the sidewall of the cup and a second position, where the tab pivotally extends away from the sidewall of the cup and the outer surface of the band. The hinge further comprises engagement means for exerting sufficient pressure against the sidewall of the cup when concomitant pressure is applied against the tab when the tab is in the second position to substantially restrict the movement of the tab to the first position. The tab further comprises support means for holding the cup when the tab is in the second position wherein the shape of the top part of the tab when the tab is in the second position conforms to the shape of the hinge. The tab also comprises locking means for substantially limiting the movement of the tab from the second position to the first position. The engagement means comprises the apex of the hinge. The sleeve further comprises at least two tabs on the top edge of the band, one tab being positioned in an opposite direction from the other tab. The sleeve also comprises a plurality of tabs on the top edge of the band. The locking means further comprises at least one flap lying in a first plane and the tab lies in a second plane. The flap and the tab comprise hinge means for movement of the flap from a first position, where the first plane is coplanar with the second plane to a second position where the first plane is non-coplanar with the second plane thereby causing the flap to abut against the sidewall of the cup when pressure is applied to the tab during holding of the cup to substantially prevent the tab from moving from the second position to the first position. The hinge further comprises a compound curve which is formed when the band is mounted on the cup and the tab is in the second position where the hinge conforms to the curvature of the sidewall of the cup and the top part of the tab conforms to the curvature of the hinge.

In a second embodiment of the present invention, a cup holding apparatus comprises a cup having a top end and a sidewall. The sidewall comprises an edge and at least one tab. The tab comprises a top part and a bottom part. The edge of the sidewall comprises the shape of a first arc and the bottom part of the tab comprises the shape of a second arc. The first and second arcs coincide to form a hinge and the hinge comprises an apex. The hinge comprises means for movement of the tab between a first position where the tab is in close proximity to the sidewall and a second position where the tab extends in a direction away from the sidewall. The hinge further comprises engagement means for exerting pressure against the sidewall when concomitant pressure is applied against the tab when the tab is in the second position to substantially restrict the movement of the tab to the first position. The tab further comprises support means for holding the cup when the tab is in the second position where the shape of the top part when the tab is in the second position conforms to the curvature of the hinge. The hinge comprises a compound curve which is formed by the hinge which conforms to the curvature of the sidewall of the cup and the top part conforms to the curvature of the hinge. The engagement means further comprises an apex on said hinge.

These and other features, aspects and advantages of the present invention will be made apparent from the following detailed description of the preferred embodiments, the appended claims and with reference to the accompanying drawing. In the drawing, the same reference numbers are used to identify similar elements in the various embodiments.

DETAILED DESCRIPTION OF THE INVENTION

A detailed description of the preferred embodiment and best mode for practicing the invention are described herein. While the present invention is described in greater detail relative to the enclosed drawings in which the preferred method of practicing the present invention are shown, it should be acknowledged that persons skilled in the relevant arts may modify certain aspects of the invention herein described while still arriving at the same positive conclusions with regards to this invention. Consequently, the following description is intended to be a general, instructive disclosure and is not intended to be restrictive upon the present invention.

Figure 1:
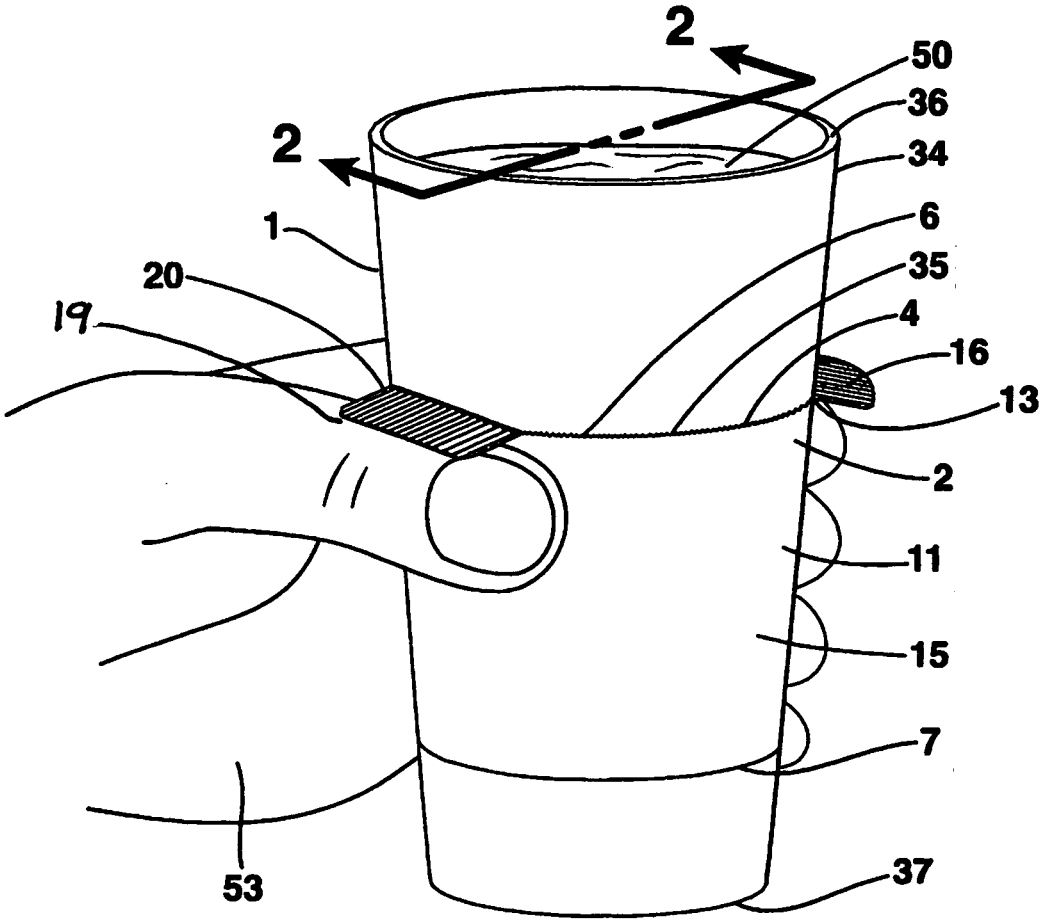
FIG. 1 is a perspective view of an embodiment of the present invention.
Figure 2:
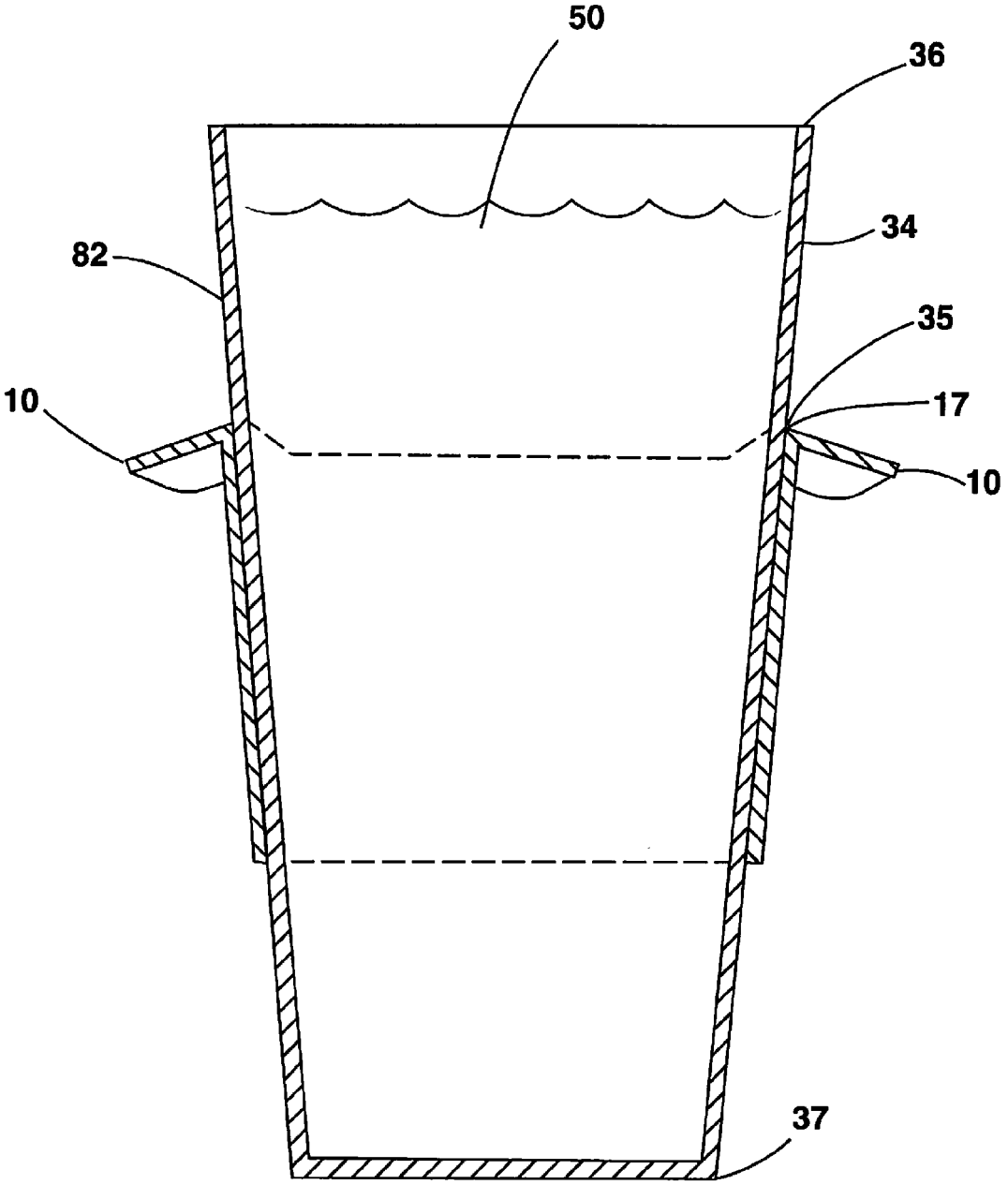
FIG. 2 is an elevational cross-sectional view taken along line 2-2 of FIG. 1.
Figure 5:
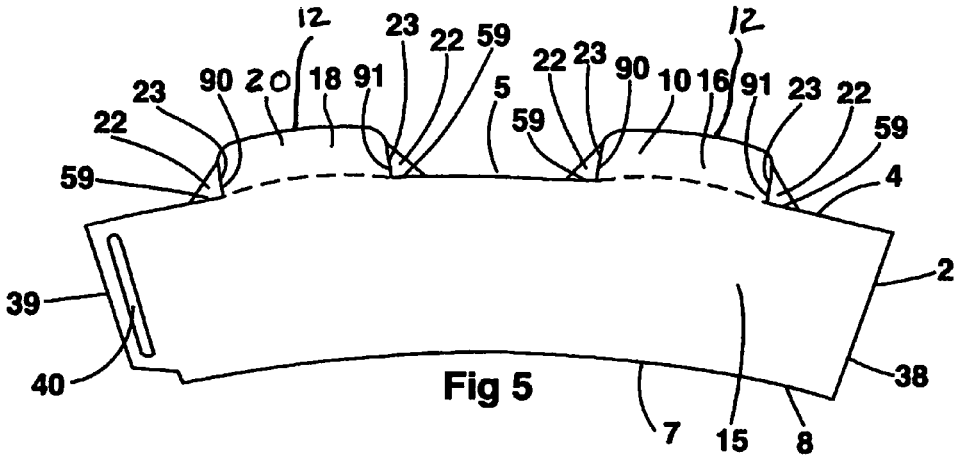
FIG. 5 is a front elevational view of the present invention.
Figure 8:
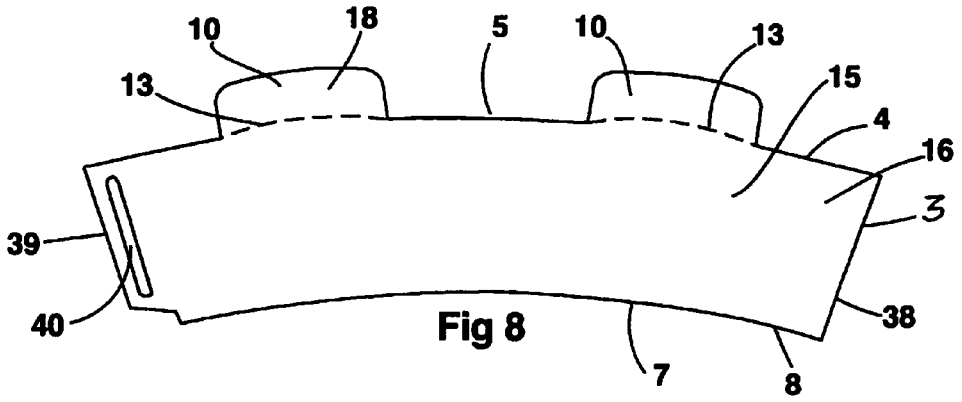
FIG. 8 is an elevational view of the present invention.
Figure 9:
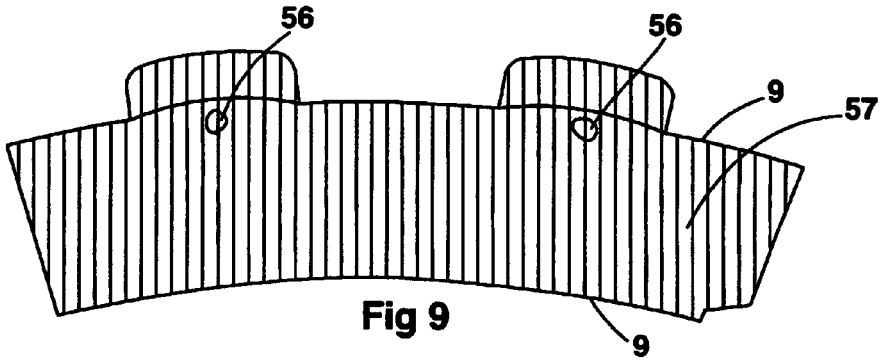
FIG. 9 is an elevational view of the present invention.

Referring to FIG. 1, there is shown a perspective view of cup 1 being held in hand 53. For illustrative purposes only, cup 1 or a container of a particular size contains hot liquid 50 such as coffee or the like. Cup 1 comprises top end 36, tubular sidewall 34 and bottom end 37. Cup 1 is shown in FIG. 1 with the sleeve or band 2 resting on the thumb and first finger. Band 2 comprises a substantially flat longitudinal, continuous and elongated, strip (FIG. 5) which is assembled to comprise band 2 (FIG. 1) and which comprises paper pulp material which is compressed into a semi-rigid product which is comfortable to the touch, absorbent to liquid spills and inexpensive to manufacture. The composition of the material of sleeve 2 is not, however, restricted to a paper product and can be also made out of any material that is suitable to form a flexible snug band around a cup. For example, plastic material such as insulating foam, a rigid molded plastic or a wood composite material is adequate. When sleeve 2 is made into its final form it comprises a continuous hollow tube or band which has a perimeter and a size corresponding to the size of the cup to permit the band to be mounted on the cup. Referring to FIG. 5, before assembly, strip 2—comprises a top edge 4 and a bottom edge 7. Top edge 4 and bottom edge 7 comprise an arcuate shape. (FIG. 8 and FIG. 9) Top edge 4 has a circumference 6 (FIG. 1) which extends completely around cup 1 when the band 2 is mounted on cup 1. Top edge 4 and bottom edge 7 are concentric to and parallel with each other. Sleeve 2 is manufactured in the form of a flat continuous elongated strip 3 as shown in FIG. 5, FIG. 8 and FIG. 9. Strip 3 comprises two opposite ends, first end 38 and second end 39 respectively, which are spaced apart and distant from one another. Either end is attached or connected to the other end during the manufacturing process to form a hollow band 2 by customarily applying a suitable adhesive material 40 on one or both of ends 38 and/or 39. Additional adhesive dollops 56 may be applied to inside surface 57 of sleeve 2 which when softened by the heat of the contents of the cup when band 2 is mounted on cup 1, band 2 will adhere to the cup thereby preventing band 2 from slipping off the cup. Band 2 further comprises mounting means for positioning the band onto the cup wherein the top edge 4 of band 2 is proximal to top end 36 of the cup and inside surface 57 of band 2 is contiguous to sidewall 34 of the cup to provide a snug fit between band 2 and sidewall 34. There is no space between band 2 and sidewall 34 when band 2 is mounted on the cup 1. Band 2 has top edge 4, bottom edge 7, inside surface 57 and outside surface 10. A portion of top edge 4 comprises a first arc 204. (FIG. 10)

Top edge 4 on band 3 comprises at least one moveable tab 20 extending upward from a first position 3. Tab 20 provides added stability by resting on the top of the user's fingers which protects them from the heat of the hot liquid in the cup which can nevertheless heat the sleeve to an unacceptable temperature for the user. FIG. 1 shows two tabs 20 located at opposite sides of band 2. It has been found that sleeves in the prior art perform moderately at best to protect the user's hands from the heat of the hot liquid in the cup because the insulation of the material is inadequate or the distance between the hand holding the cup and the hot cup sidewall is too close. Further, the prior art sleeves do not provide a secure and comfortable support for safely holding a full cup of hot coffee. In the subject matter of the present invention, tabs 20 provide a stable, comfortable support which significantly reduces the heat transference from the hot liquid to the user.

Figure 6:
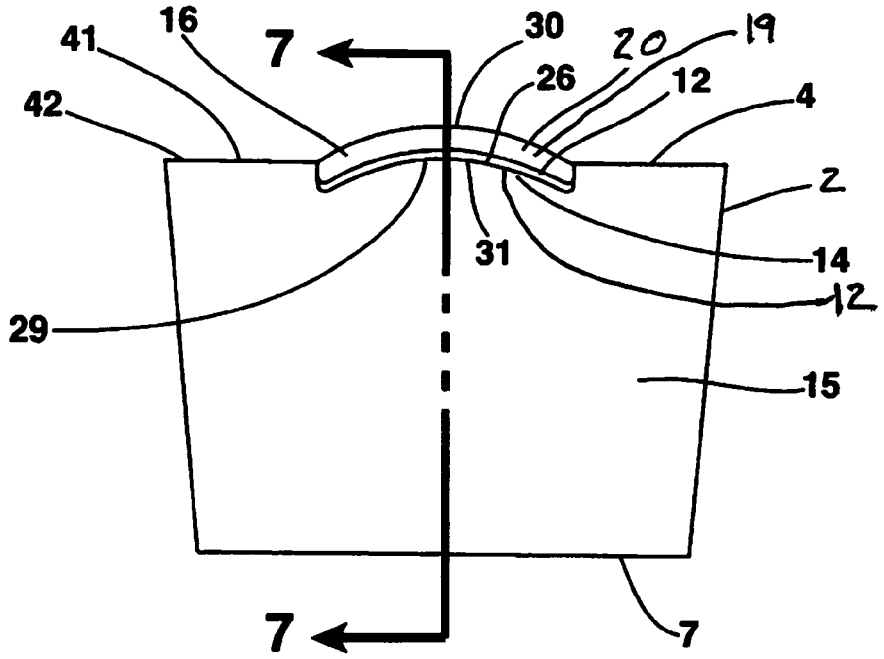
FIG. 6 is a front elevational view of the present invention.
Figure 7:
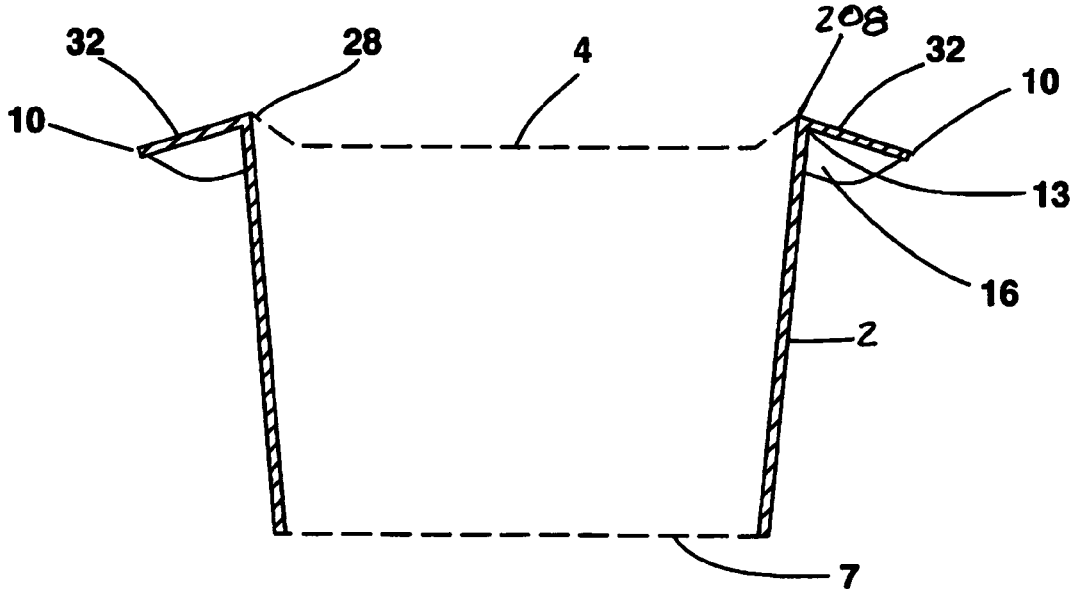
FIG. 7 is an elevational cross sectional view taken along line 7-7 of FIG. 6.
Figure 10:
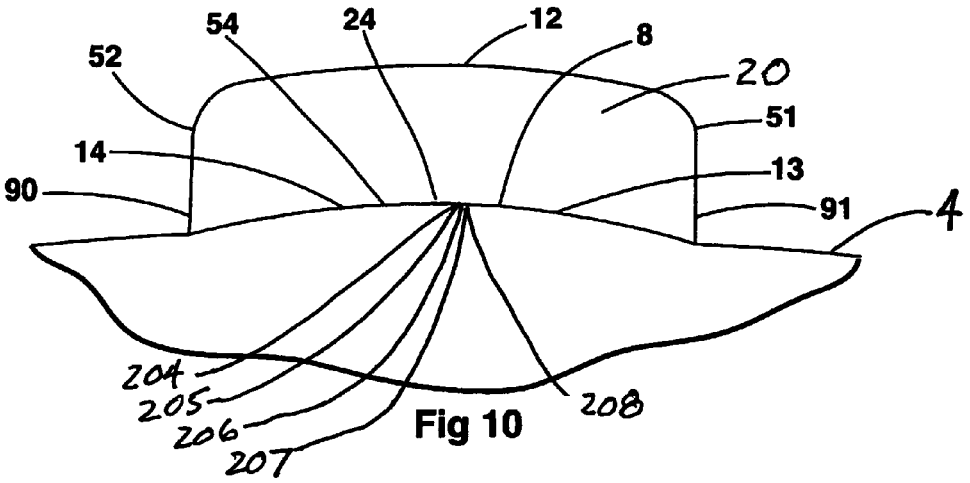
FIG. 10 is an elevational view of the present invention.
Figure 13:
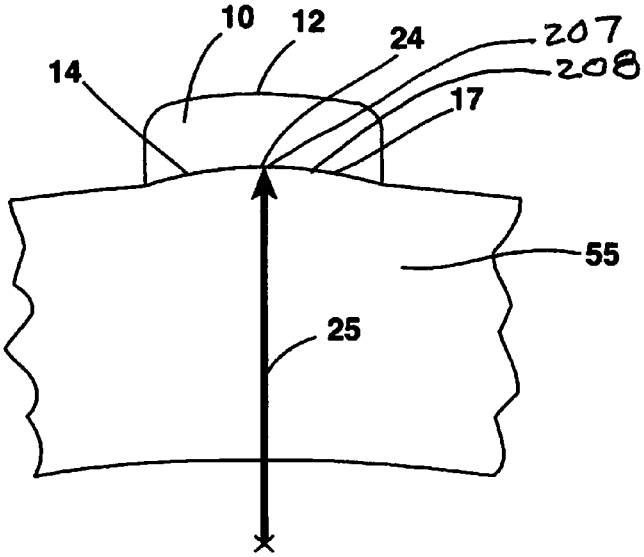
FIG. 13 is partial elevational view of the present invention.

Referring to FIG. 10 and FIG. 13, tab 20 comprises top part 12 and bottom part 13, which is below top part 12 and attached to top edge 4 of the sleeve. Bottom part 13 comprises a second arc 206. Second arc 206 comprises a second apex 207. Top edge 4 of band 2 comprises a first arc 204. First arc 204 comprises a first apex 205. First arc 204 coincides with second arc 206. The combined first arc 204 and second arc 206 comprise a hinge 208 which allows tab 20 to move between a first position 18 and a second position 19. Hinge 208 comprises a third apex 210. When tab 20 is in its first position 18 tab 20 lies in the same plane as the band 2. In the first position 18, tab 20 extends towards the top end of the cup and when the band is mounted on the cup, tab 20 is in close proximity to the sidewall of the cup. Hinge 208 comprises means to allow tab 20 to move to a second position 19 (FIG. 6 and FIG. 7) wherein tab 20 extends away from the sidewall 34 of the cup 1 and away from the outer surface 10 of the band 2 in a transverse juxtaposition. The positioning of tab 20 in its second position 19 provides a support or ledge which, due to the weight of the cup 1, will cause the cup 1 to rest on top of the user's fingers while gripping the cup 1. This added support provides significant stability and security when holding the cup 1 during drinking or movement. Hinge 208 further comprises engagement means in the form of a third apex 210 for exerting sufficient pressure against the sidewall 34 of the cup 1 when concomitant pressure is applied against the tab 20 when the tab 20 is in the second position 19 to substantially restrict tab 20 from moving from the second position 19 to the first position 18. When tab 20 is in its second position 19, it is noted that due to the geometry of the hinge 208, the shape of the top part 12 of the tab 20 conforms to the shape of the hinge 208. (FIG. 6) The structure of the present invention which restricts the movement of the tab from moving from its second position 19 to the first position 18 when band 20 is mounted on the cup is the third apex of hinge 208. Tab 20 further comprises support means for holding the cup 1 when the tab 20 is in the second position 19 where the shape of the top part 12, when the tab is in the second position 19, conforms to the shape of the hinge 208. Hinge 208 further comprises a compound curve when the band 2 is mounted on the cup 1 so that the hinge 208 conforms to the shape of the sidewall 34 of the cup 1 and the top part 12 of the tab conforms to the shape of the hinge 208.

Figure 11:
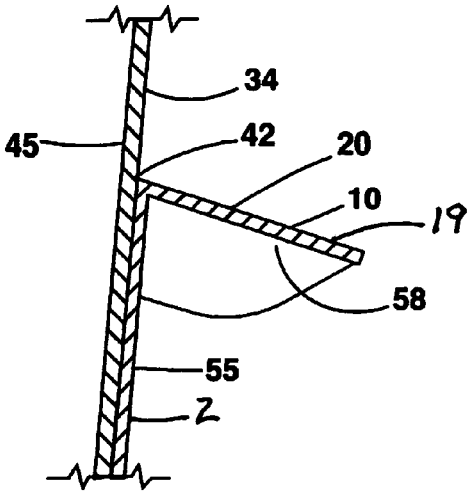
FIG. 11 is a partial cross sectional elevational view of the present invention shown in FIG. 2.
Figure 12:
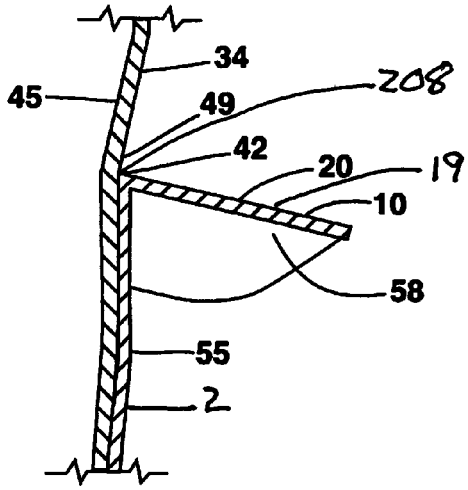
FIG. 12 is a partial cross sectional elevational view of the present invention.

Referring to FIG. 11 and FIG. 12, a partial cut away view of sleeve 2 and the cup sidewall 34 is shown. In FIG. 11, tab 20 is shown in its second position 19. Sleeve sidewall 55 rests adjacent cup sidewall 35 with minimal force or pressure at the moment before the cup is held by the user. As previously stated, sleeve 20 is snugly mounted on cup 1. When the cup is held by a user, the weight of the cup and contents therein produces a downward force. This downward force produces a concomitant upward force against tab 20 as the hand presses against the bottom side of tab 20. Referring to FIG. 12, the upward force against tab 20 causes tab 20 to pivot about hinge 208 and move upward towards its first position 18. As tab 20 tries to move upward due to the forces created by holding the cup against the tab, third apex 210 of hinge 208 pushes against sidewall 34 thereby creating a force against sidewall 34. Sidewall 34 deforms slightly by the pressure exerted by third apex 210 of hinge 208 but due to the radious 25 of the curvature of hinge 208, the third apex 210 is long enough to hold against sidewall 34 to prevent tab 20 from moving further upward towards its first position 18 thereby positioning tab 20 in a substantially stationary position.

Mounting sleeve 20 to cup 1 is an easy process. Sleeve 20 is opened to form a tube or first opening 41. Opening 41 is of a size and diameter which will accommodate the insertion of cup 1 into and through tube sleeve 2 until circumference 6 of top edge 4 of sleeve 2 substantially equals circumference 35. Because the typical coffee cup is tapered, the insertion of sleeve 2 will stop when the size of the circumference of sleeve 2 and first opening 41 are equal. After cup 1 is inserted through opening 41, third apex 210 is adjacent to sidewall 34 of cup 1 when tab 20 is in the first position 18. When tab 20 is moved downward towards its second position 19, third apex 210 comes into contact with sidewall 34 thereby limiting the movement of tab 20 from moving from the second position 19 to the first position.

Figure 18:
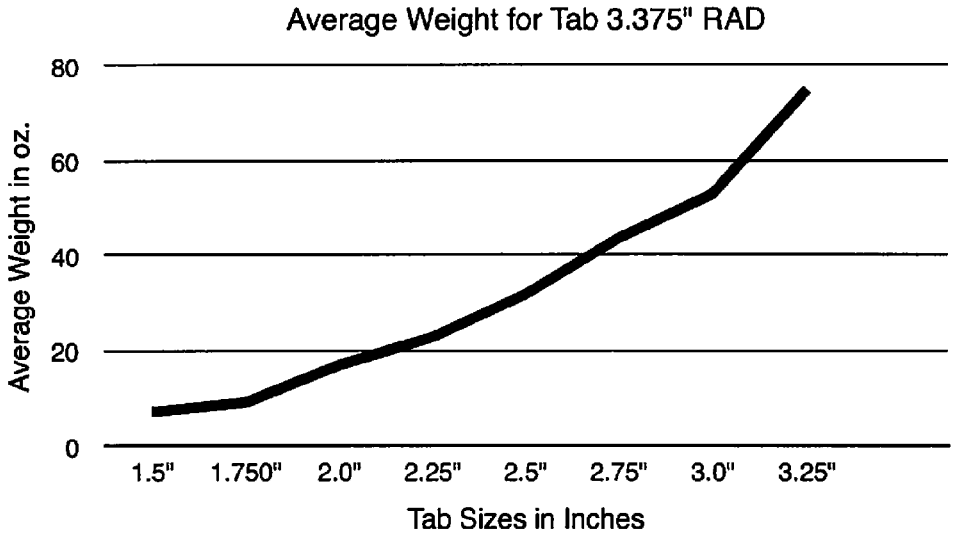
FIG. 18 is a chart comparing average weight, tab size and 3.375" radius.
Figure 19:
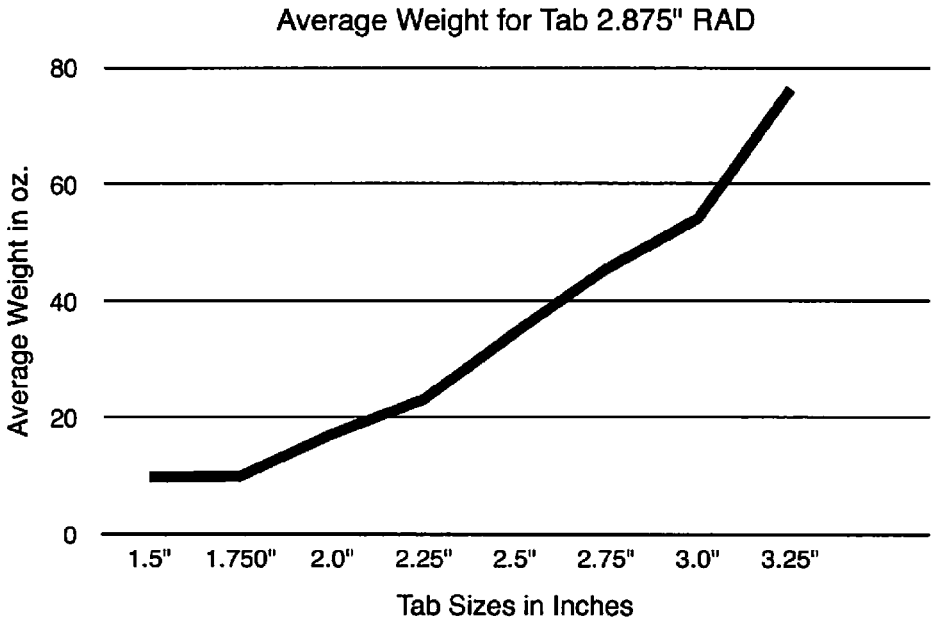
FIG. 19 is a chart comparing average weight, tab size and 2.875" radius.
Figure 20:
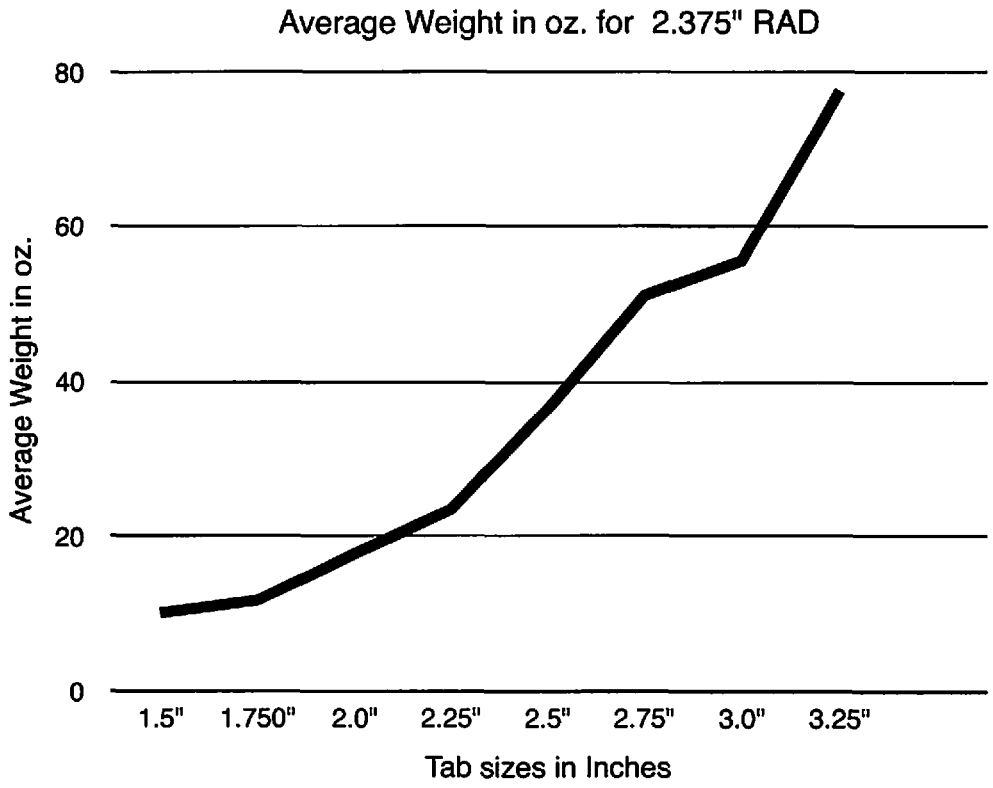
FIG. 20 is a chart comparing average weight, tab size and 2.375" radius.

The subject matter of the present invention has been surprisingly and effectively found to function very well and to comfortably and safely support a full large cup of coffee. Experimental testing of the structure of the present invention proves that the design and functionality of the present invention works exceedingly well. In the testing, a cup was mounted to a sleeve comprising two tabs attached at opposite sides to the sleeve. The tabs of the cup were mechanically supported to simulate a person holding the cup and also to avoid non-uniformity in supporting forces for each test. Various weights, in increasing increments, from 10 oz in weight to 80 oz in weight were added to the inside of the cup in the form of steel ball bearings of equal weight to determine the failure rate of the tabs, which is when the tabs would fail to hold in the second position 19. It was found that a normal large coffee cup which holds 16 fl oz weights approximately 17 oz. In the test, with a tab size of 3.25 inches in length, the tab using the sleeve of the present invention can adequately support a weight of approximately 75 oz, which is more than three time the weight of a 16 fl oz cup of coffee before the tabs reached their failure weight. Referring to FIG. 18, FIG. 19 and FIG. 20, the variations of the radii 25 of each hinge 208 used in the test, from 2.375 inches, to 3.375 inches, did not substantially affect the strength of the variously sized tabs used in the testing. It was found, however, that the longer the tab length of top part 12, the greater the weight that tab 20 could support. For example, a small tab of 1.5 inches long could barely hold a half of cup of coffee before failure, while a tab length of 3.125 inches long supported a cup weight of over three times the weight of a cup. This test data verifies the functionality of the present invention and proves that the use of a tab of at least 2.5 inches and having an arcuate radius 25 of at least 2.375 inches will safely support a full 16 oz. cup of coffee without failing by a fracture of 2. Further, it was found that an optimal length of tab comprises approximately ¼ of the length of the circumference of the sleeve for maximum effectiveness, although somewhat longer or shorter tab lengths still provide sufficient strength and support to maintain the safe support of the cup. Additionally, more than 2 tabs can be used to increase comfort, safety and stability if desired, although using more than 2 tabs is not needed for the band to operate properly and safely.

Referring to FIG. 1, FIG. 8 and FIG. 10, hinge 208 extends in a compound curve outwardly to conform to the sidewall 34 shape of cup 1 when band 2 is mounted on the cup and the top part 12 of the tab 20 conforms to the shape of hinge 208. Hinge 208 extends upward in a concave curve 29 towards the direction of top end 2 of cup 1.

Additional structure may be added to tab 20 in the form of a locking means 22 (FIG. 3, FIG. 4 and FIG. 5) which will prevent tab 20 from failing, i.e., moving from the second 19 towards the first position 18.

Figure 3:
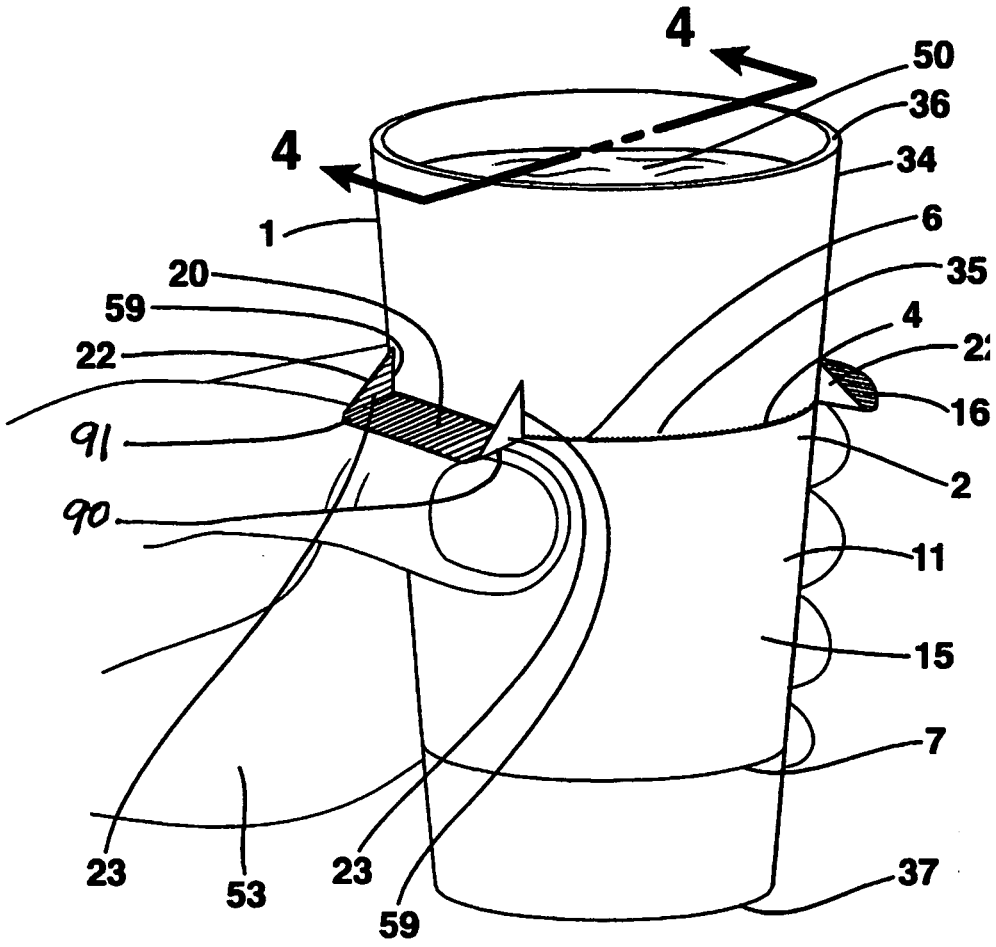
FIG. 3 is a perspective view of another embodiment of the present invention.
Figure 4:
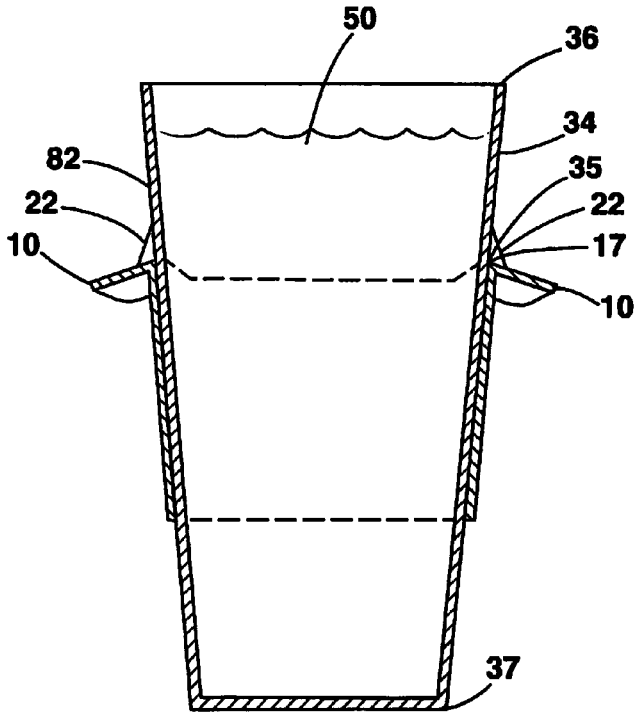
FIG. 4 is an elevational cross sectional view taken along line 4-4 of FIG. 3.

As shown in FIG. 3, FIG. 4 and FIG. 5, at least one triangularly shaped flap 22 or locking tab lies in first plane and is attached to tab 20 which lies in a second plane, although the use of four flaps is preferred. Tab 20 comprises two edges, first edge 90 and second edge 91. Flap 22 comprises hinge 23 which is attached to tab edge 90 and first edge 91, and support or second edge 59 which is not attached to tab 10. Flap 22 is able to move between a first position which is coplanar with tab 20 and a second position which is non-coplanar with tab 20. When tab 20 is in its second position 19 (FIG. 3), each flap 22 may be folded upwardly whereby edge 59 is contiguous to and abuts against cup sidewall 34. This configuration allows second edge 59 to limit the movement of tab 10 towards or against sidewall 34 when tab 20 is in the second position 19. Flap 22 acts as a brace to prevent tab 20 from moving in an upward direction towards its first position 18 against cup sidewall 34 by abutting against sidewall 34 of the cup 1 when pressure is applied to the tab 20 to substantially prevent the tab 20 from moving from its second position 19 to its first position 18. Locking tab 22 can be easily and inexpensively manufactured to provide additional stabilizing functionality to tab 20 if desired.

Figure 14:
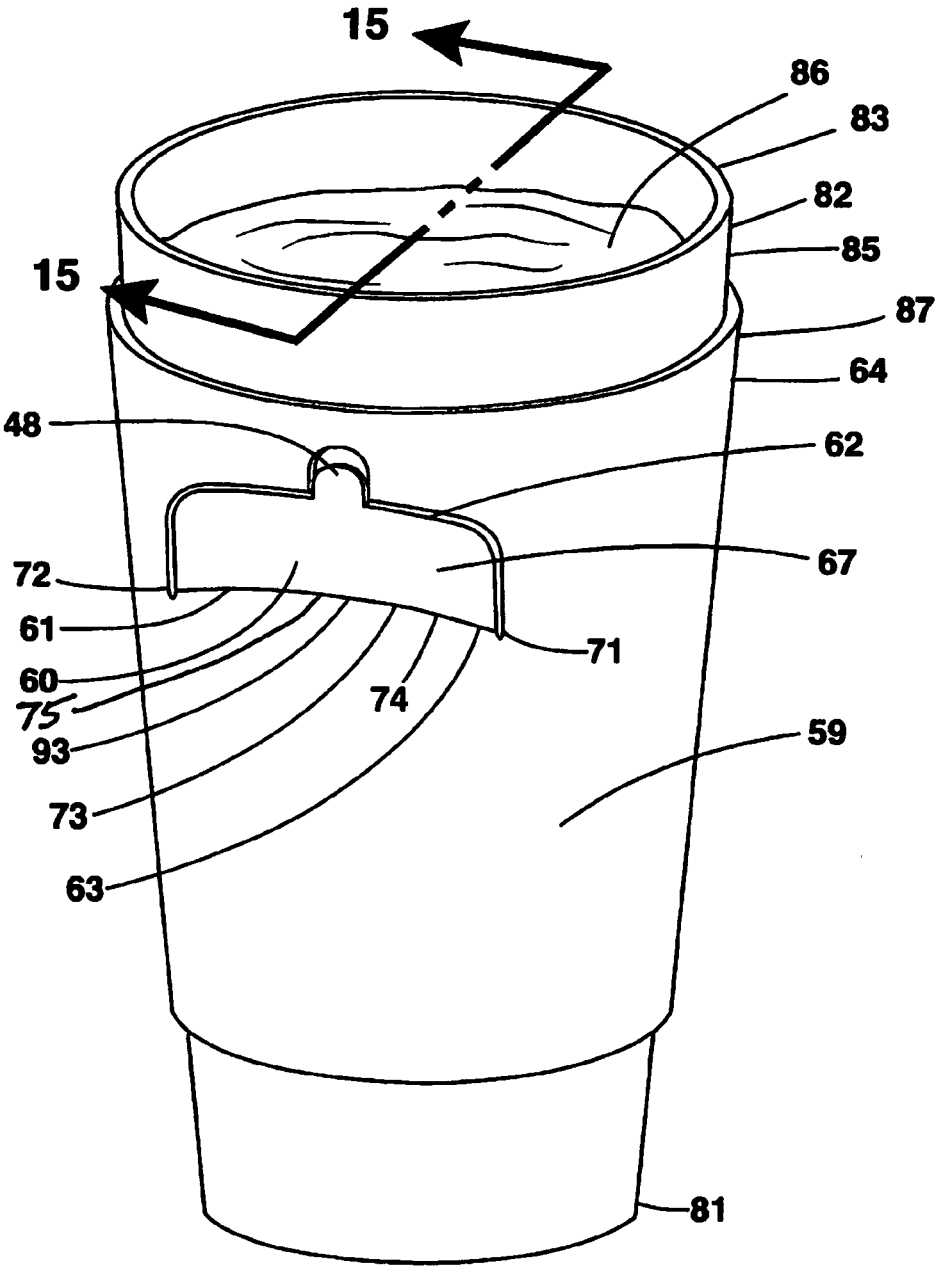
FIG. 14 is a perspective view of a third embodiment of the present invention.
Figure 15:
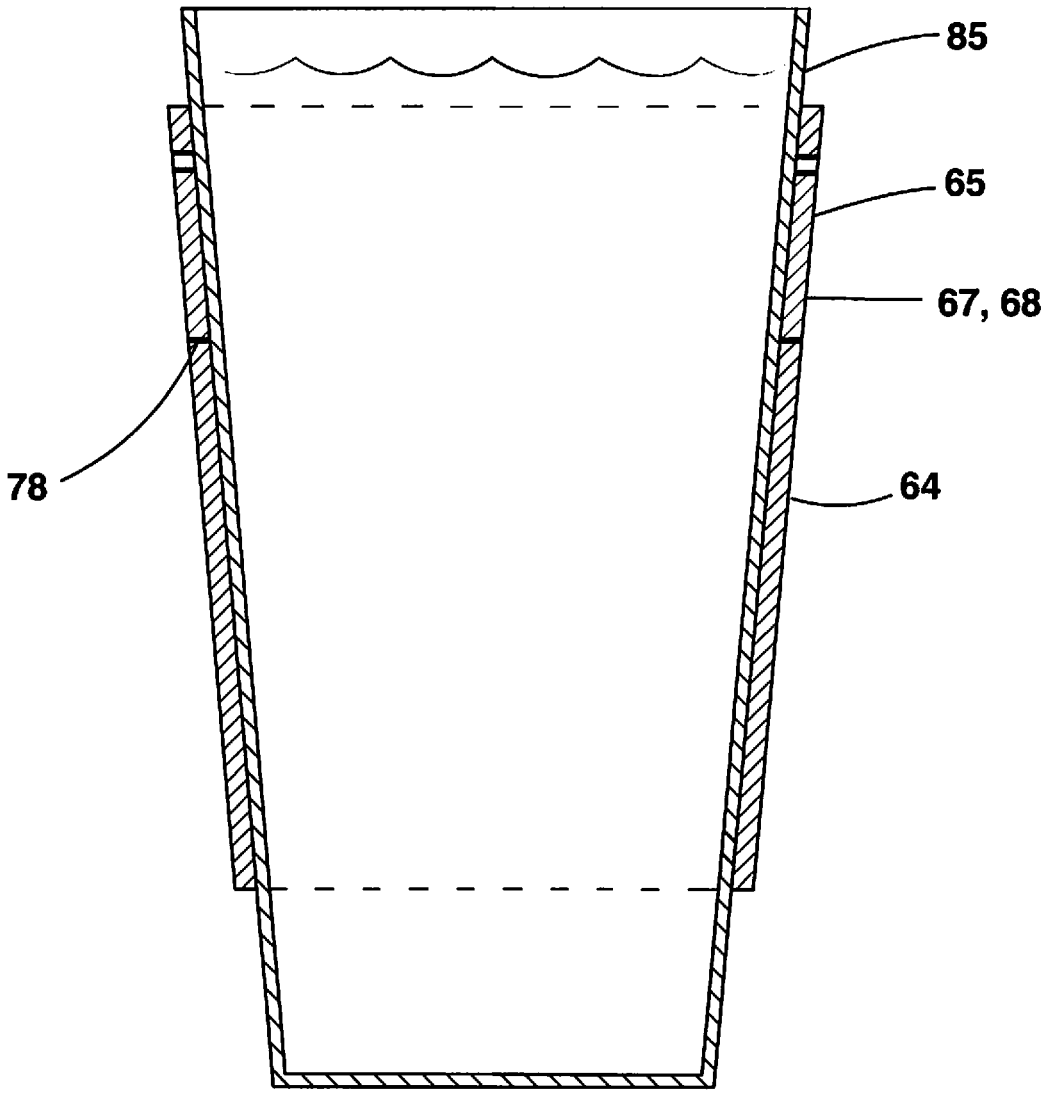
FIG. 15 is an elevational cross sectional view of the present invention along line 15-15 of FIG. 14.
Figure 16:
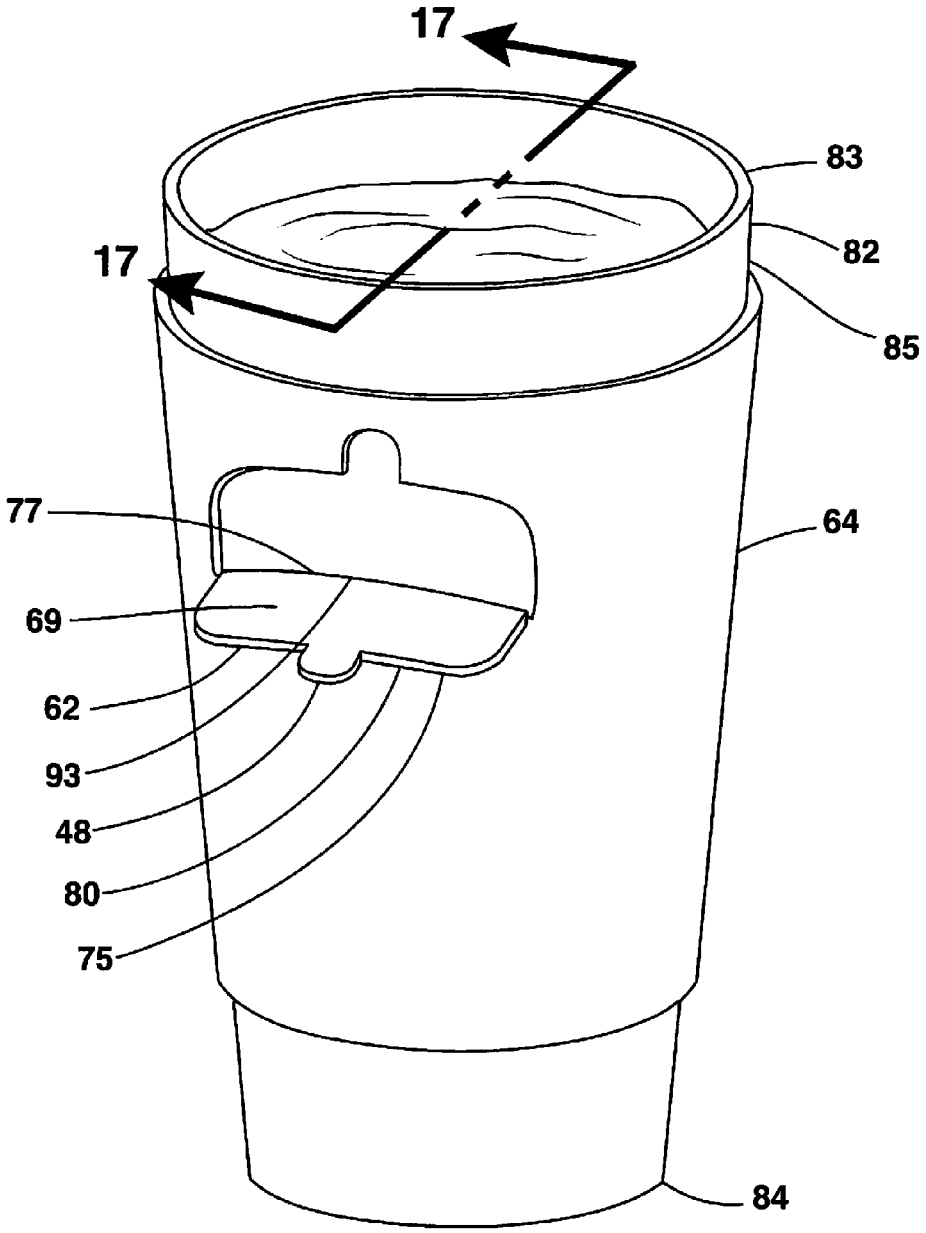
FIG. 16 is a perspective view of the third embodiment of the present invention shown in FIG. 14.
Figure 17:
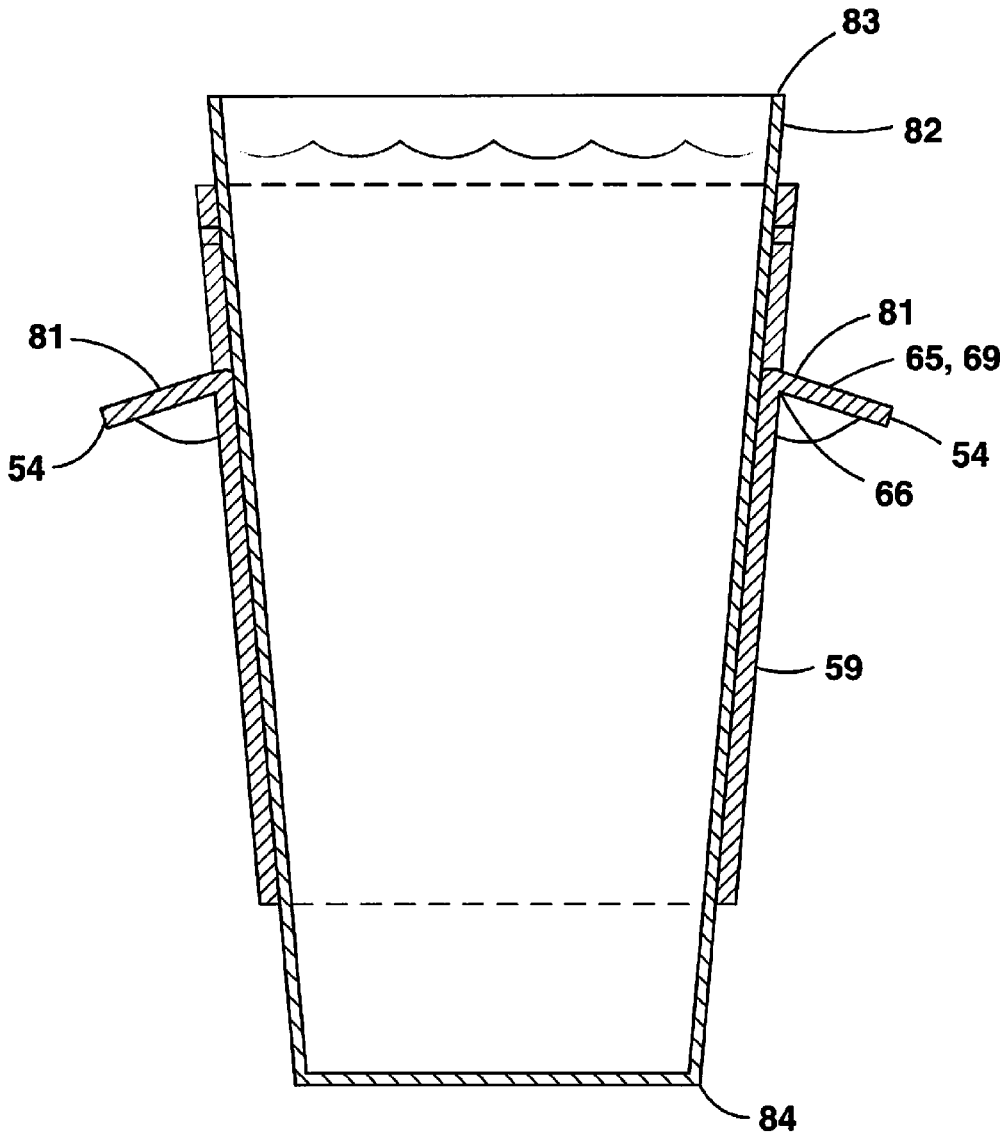
FIG. 17 is an elevational cross-sectional end view of the third embodiment of the present invention along line 17-17 of FIG. 16.

A second embodiment of the subject matter of the present invention is disclosed in FIG. 14. A cup 85 is shown having a tubular sidewall 82. Sidewall 82 lies in plane 64 and has a circumference 87, top end 83 and bottom end 81. A cup holder or tab 60 is on, integral with, embedded within or made a part of the cup sidewall 82. Tab 60 extends upward and is coplanar with the side-wall plane 64. Tab 60 has an upper edge or top part 62 and a bottom edge or bottom part 61. Bottom edge 61 has an arcuate form or line 63. Tab 60 extends up-ward in a first position 67 wherein the tab is closed and coplanar with the plane of the sidewall 64 of cup 60 and articulates downwardly to a second position 69 (FIG. 16) wherein tab 60 is open and non-coplanar with plane 64 of the cup sidewall 82. Top part 62 is distant and spaced away from and does not touch the sidewall of the cup when it is in the second position. Arcuate form 63 curves with the curvature of cup sidewall 82 to become circular when view axially. When viewed elevationally, arcuate form 63 extends upward toward top end 83 of the cup 85 opening along a convex curved line alone arcuate form 63 with respect to top part or end 62. Tab 60 extends in a compound curve outwardly from cup 85 so that upper edge or top part 62 is convex when viewed elevationally whereby crown 93 of bottom part 61 is configured to resist folding back to the closed flat and coplanar position by virtue of its engagement with sidewall 82 of cup 85. Additionally, crown 93 moves towards and engages with cup sidewall 82 whereby the movement of tab 60 is limited towards first position 67 when vertical upward pressure is applied to tab 60. Tag 48 is provided to assist in gripping tab 60 when tab 60 is coplanar with cup sidewall 82 in order to pull tab 60 from first position 67 to its second position 69.

Figure 21:
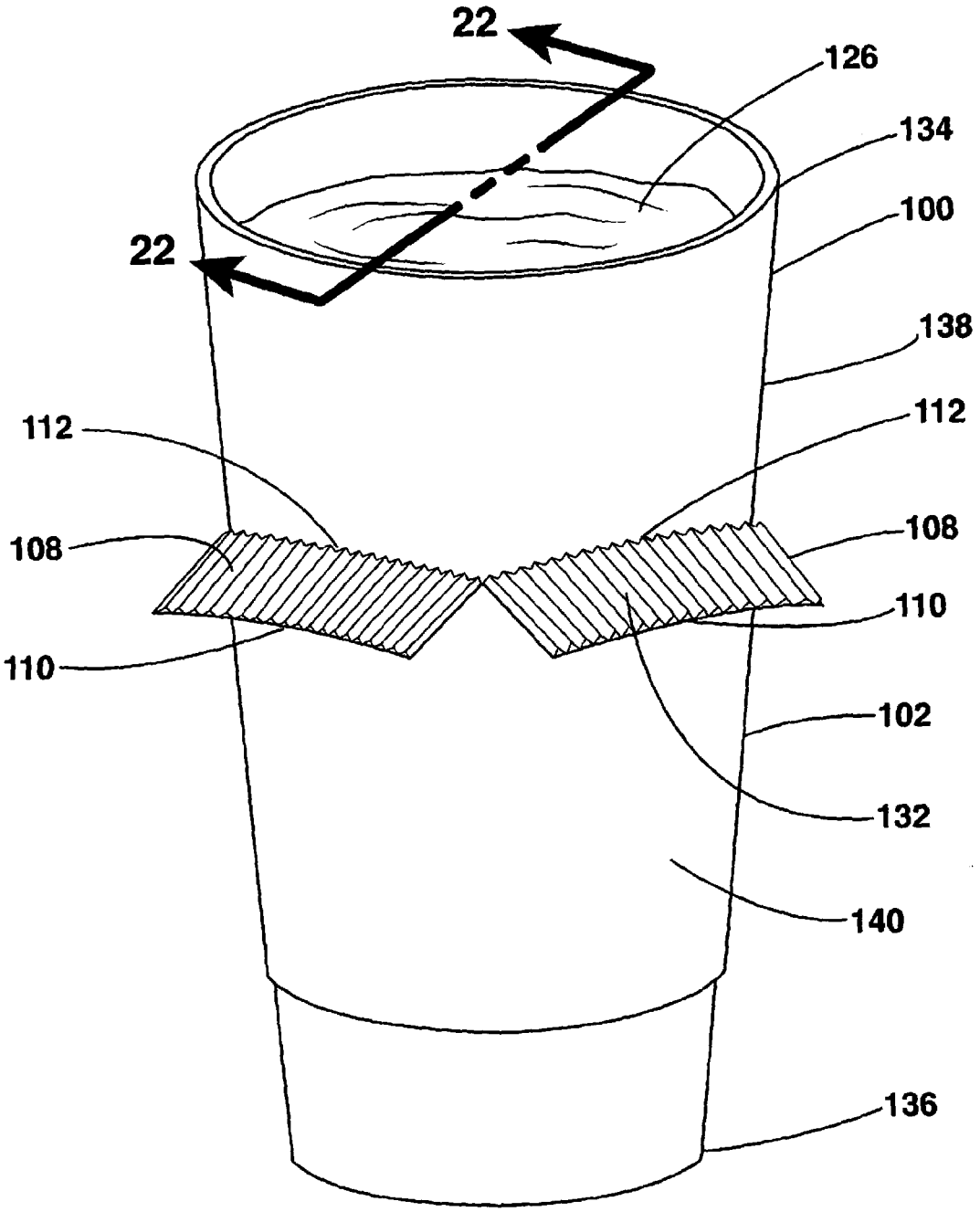
FIG. 21 is a perspective view of the of a fourth embodiment of the present invention.
Figure 23:
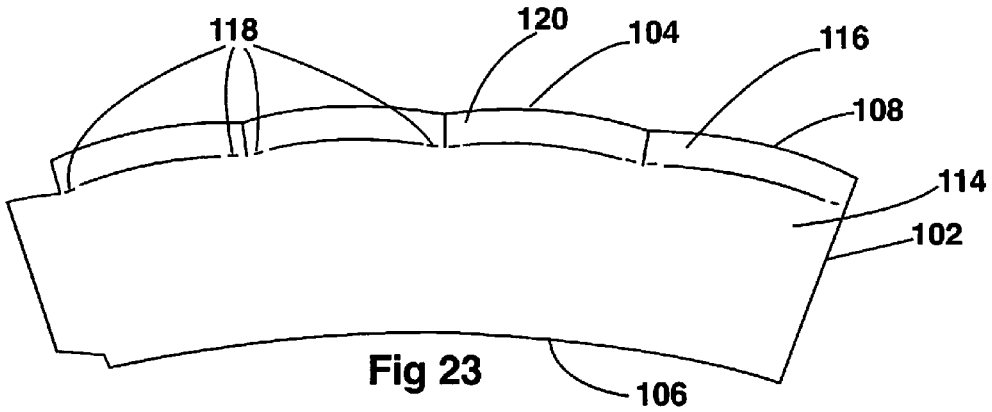
FIG. 23 is an elevational view of the fourth embodiment of the present invention.
Figure 24:
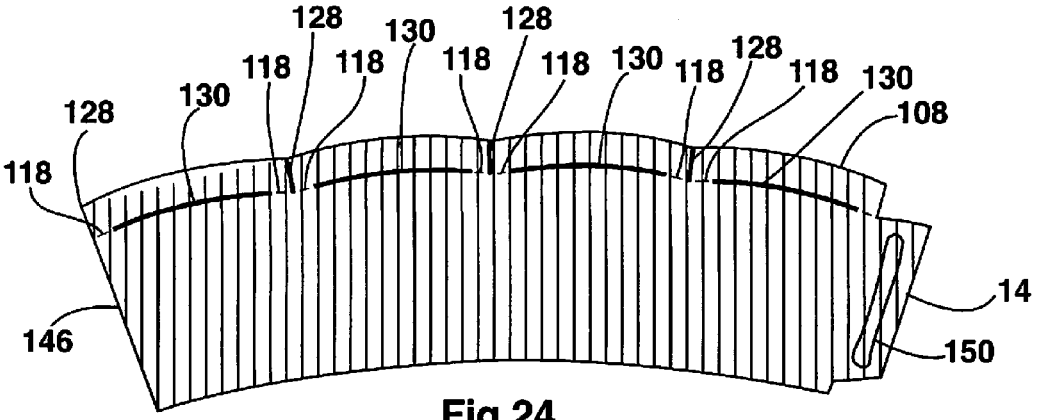
FIG. 24 is an elevational view of the fourth embodiment of the present invention; and, FIG. 25 is a partial elevational view of the fourth embodiment of the present invention.

Referring to FIG. 21, there is shown a perspective view of a fourth embodiment of the present invention. For illustrative purposes only, cup 100 contains hot liquid 126 such as coffee or the like. Cup 100 comprises top end 134, tubular sidewall 138 and bottom end 136. Cup 100 is shown in FIG. 23 and FIG. 24 with a substantially flat continuous and elongated band or sleeve 102 which preferably comprises paper pulp material which is compressed into a semi-rigid product which is comfortable to the touch, absorbent to liquid spills and inexpensive to manufacture. The composition of the material of sleeve 102 is not, however, restricted to a paper product and can be also made out of any material that is suitable to form a flexible band around a cup. For example, plastic material such as insulating foam or a rigid molded plastic may be used. Further, a wood composite material will also be adequate. When sleeve or portable cup holder 102 is made into its final form it comprises hollow tube 140. Band 102 comprises top 110 and bottom 112 which are each in arcuate form 142 and 144, respectively. (FIG. 25) Prior to inserting a cup into the open sleeve 102, the band is tubular in shape. Band top has a circumference which extends completely around cup 100 when the sleeve or band 102 is mounted on cup 100. Top 110 and bottom 112 are concentric to and parallel with each other. Sleeve 102 is manufactured in the form of a flat continuous elongated band as shown in FIG. 23 and FIG. 24. Sleeve 102 comprises two opposite ends 146 and 148 respectively, which are distal from one another. These ends are attached to one another during the manufacturing process by applying a suitable adhesive material 150 at one or both of the ends.

Top 104 of sleeve 102 comprises several moveable tabs 108 to facilitate holding the cup and protecting one's fingers from the hot contents because even with a conventional band or sleeve of the prior art, the heat of the hot liquid in the cup can nevertheless heat the sleeve to an unacceptable temperature.

Figure 25:
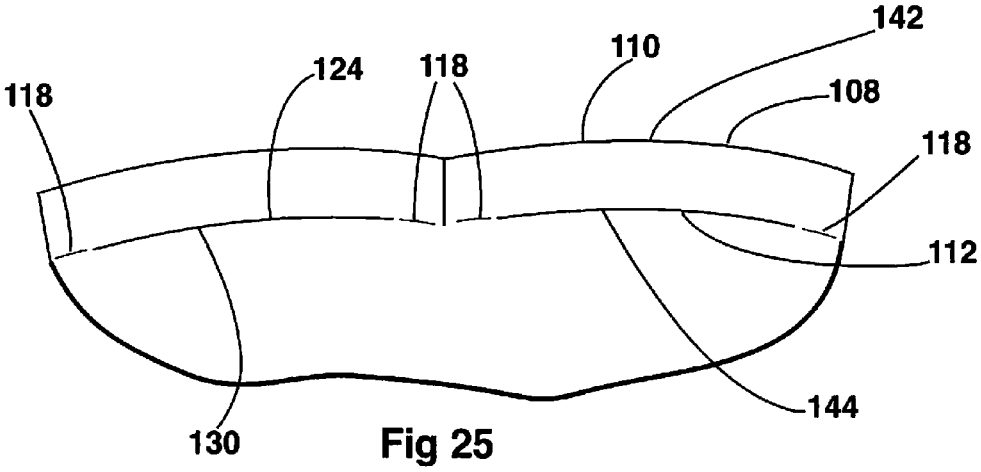

Referring to FIG. 25, tab 102 comprises top part 110 and bottom part 112 which is below the top part 110. Bottom part 112 of each tab has an arcuate line or form 144 which is upwardly and comprises crown 130 along bottom arcuate form 144. Tab 108 is configured so that upon insertion of the cup, having a sidewall circumferential size corresponding to the sleeve size, tab 102 is articulated or moved from a closed flat position which lies coplanar in sleeve plane 114, to an operative position which lies in plane 116 outward or non-coplanar from sleeve plane 114 (FIG. 21) Line 144 curves circumferentially along the same circumference of cup sidewall 138 at the position that sleeve 102 is mounted to cup 100. Line 144 further extends upward toward the top 110 a convex curve 130. When tab 108 is in its closed or second position (FIG. 21) bottom part 112 extends radially in a compound curve and arcuate bottom 144 extends in a convex direction 130 to top 134. This structure causes tab 108 to resist folding back to the open or first position 120 by virtue of the contact of sidewall 138 with crown 124.

Figure 22:
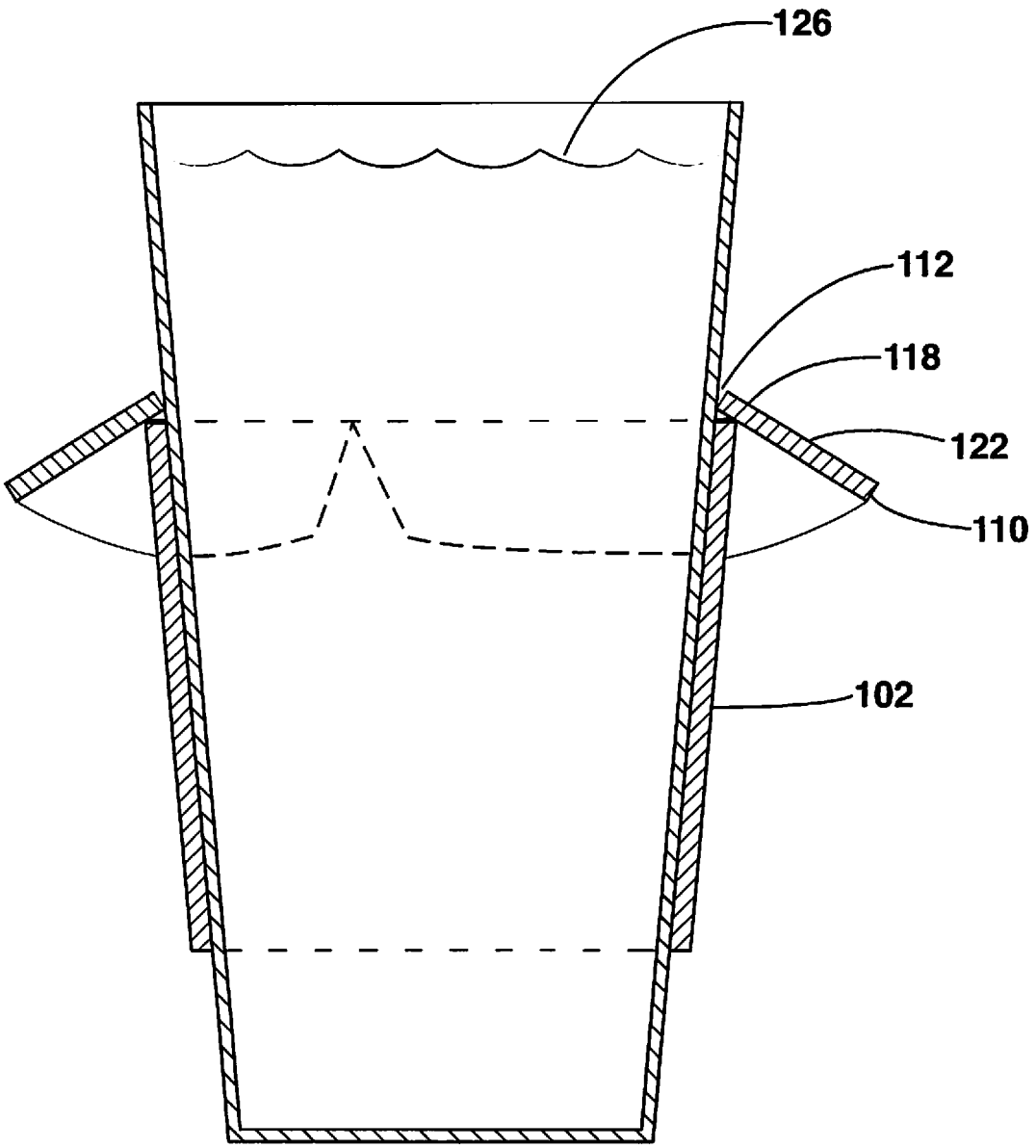
FIG. 22 is a cross-sectional elevational view of the fourth embodiment of the present invention along line 22 of FIG. 21.

Referring to FIGS. 23, 24 and 25, at least one tab 108 is formed on top 104 by cutting slits 128 and 130 to form the outline of tab 108. Tab 108 is pulled downwardly to form tab 108 which articulates about hinges 118. Tab 108 comprises hinges 118 which are located along arcuate bottom form 144 of bottom part 112 of tab 108 for movement between first position 120 wherein first plane 114 is coplanar with second plane 116 and second position 122 (FIG. 22) wherein first plane 114 is non-coplanar with second plane 116 and the movement of tab 108 from second position 122 to first position 114 is limited due to crown 124 of arcuate bottom form 144 of bottom 112 of tab 108 being adjacent to, in contact with and urging against sidewall 138 of cup 100. In the preferred embodiment the hinges 118 comprise the folded corrugated material along arcuate bottom form 144 which is sufficiently sturdy enough to keep its integrity during many movements.

Other embodiments and variation of the cup lid in keeping with the present invention may be realized, without departing from the spirit and scope of the appended claims. Although the present invention has been described in considerable detail with reference to certain preferred embodiments hereof, other embodiments or versions of the invention are possible. Therefore, the spirit and scope of the appended claims should not be limited to the description of the preferred versions contained therein. Any element in a claim that does not explicitly state "means for" performing a specified function, is not to be interpreted as a "means" claim as specified in 35 U.S.C. §112, ¶6.

The reader's attention is directed to all papers and documents which are filed concurrently with this specification and which are open to public inspection with this specification and the contents of all such papers and documents are incorpo-rated herein by reference. All features disclosed in this specification (including any accompanying claims, abstract and drawings) may be replaced by alternative features serving the same, equivalent or similar purposes, unless expressly stated oth-erwise. Unless expressly stated otherwise, each feature disclosed is one example only of a generic series of equivalent or similar features.

What is claimed is:

1. A holding sleeve for use with a cup, the cup having a top end and an outer sidewall, said holding sleeve comprising:
   a. a substantially flat longitudinal and continuous strip;
   b. said strip comprising a first end and a second end;
   c. said first end is spaced apart and distant from said second end;
   d. attachment means on at least either said first end or said second end for connecting said first end to said second end to form a hollow band;
   e. said band comprises a top edge, an inside surface and an outside surface;
   f. mounting means on said band for positioning said band onto the cup wherein said top edge of said band is proximal to the top end of the cup and said inside surface of said band is contiguous to the sidewall of the cup thereby providing a snug fit between said band and the sidewall;
   g. at least one tab on said top edge of said band;
   h. said tab comprising a top part and a bottom part;
   i. said top edge of said band comprises the shape of a first arc;
   j. said bottom part of said tab comprises the shape of a second arc;
   k. said first arc and said second arc coincide to form a hinge;
   l. said hinge comprises an apex;
   m. said hinge comprises means for facilitating the movement of said tab between a first position, wherein said tab extends towards said top end of the cup and is in close proximity to the sidewall of the cup, and a second position, wherein said tab extends away from the sidewall of the cup and said outer surface of said band;
   n. said hinge further comprises engagement means for exerting sufficient pressure against the sidewall of the cup when concomitant pressure is applied against said tab when said tab is in said second position which substantially restricts the movement of said tab to said first position; and,
   o. said tab further comprises support means for holding the cup when said tab is in said second position wherein the shape of said top part of said tab when said tab is in said second position conforms to the curvature of said hinge.

2. The holding sleeve of claim 1 wherein said hinge further comprises a compound curve which is formed when said band is mounted on the cup and said tab is in said second position where said hinge conforms to the curvature of the sidewall of the cup and said top part of said tab conforms to the curvature of said hinge.

3. The holding sleeve of claim 1 wherein said tab further comprises locking means for substantially limiting the movement of said tab from said second position to said first position.

4. The holding sleeve of claim 3 wherein said locking means further comprises:
   a. at least one flap on said tab;
   b. said flap lying in a first plane;
   c. said tab lying in a second plane; and,
   d. hinge means on said flap and on said tab for movement of said flap from a first position, wherein said first plane of said flap is coplanar with said second plane of said tab, to a second position wherein said first plane of said flap is non-coplanar with said second plane of said tab thereby causing said flap to abut against the sidewall of the cup when pressure is applied to said tab thereby substantially preventing said tab from moving from its second position to its first position.

5. The holding sleeve of claim 1 wherein said engagement means further comprises said apex.

6. The holding sleeve of claim 1 and further comprising at least two tabs on said top edge of said band, one tab being positioned in an opposite direction from the other tab.

7. The holding sleeve of claim 1 and further comprising a plurality of tabs on said top edge of said band.

8. A cup holding apparatus for use with a cup, the cup having an outer sidewall, and said holding apparatus comprising:
   a. at least one tab on the outer sidewall;
   b. said tab comprises a top part and a bottom part;
   c. said bottom part comprises a hinge;
   d. said hinge comprises the shape of an arc;

e. said arc comprises an apex;

f. said hinge further comprises means for movement of said tab between a first position wherein said tab is in close proximity to the outer sidewall and a second position wherein said top part of said tab extends in a direction away from the outer sidewall and is distant and spaced away from the outer sidewall;

g. said apex comprises engagement means for exerting pressure against the outer sidewall when concomitant pressure is applied against said tab when said tab is in said second position which substantially restricts the movement of said tab to said first position; and, h. said tab further comprises support means for holding the cup when said tab is in said second position wherein the shape of said top part substantially conforms to the shape of said hinge when said tab is in said second position.

9. The cup holding apparatus of claim 8 wherein said hinge comprises a compound curve when said tab is in said second position.

* * * * *